US005896994A

United States Patent [19]

Krebs

[11] Patent Number: 5,896,994

[45] Date of Patent: Apr. 27, 1999

[54] SEALED ARTICLE

[75] Inventor: Arthur T. Krebs, Spartanburg, S.C.

[73] Assignee: W. R. Grace & Co.-Conn., Duncan, S.C.

[21] Appl. No.: 08/696,137

[22] Filed: Aug. 13, 1996

Related U.S. Application Data

[63] Continuation of application No. 08/294,669, Aug. 23, 1994, abandoned.

[51] Int. Cl.[6] ..... B65D 85/84

[52] U.S. Cl. ..... 206/524.4; 206/204; 206/205

[58] Field of Search ..... 206/204, 205, 206/206, 524.4; 426/129, 127

[56] References Cited

U.S. PATENT DOCUMENTS

| | | | |
|---|---|---|---|
| 2,802,743 | 8/1957 | Ellies | 426/129 |
| 2,825,651 | 3/1958 | Loo et al. | 206/205 X |
| 3,101,864 | 8/1963 | Glickman | 426/129 X |
| 4,192,773 | 3/1980 | Yoshikawa et al. | 206/205 X |
| 4,410,578 | 10/1983 | Miller | 206/204 |
| 4,702,377 | 10/1987 | Grone | 426/129 X |
| 4,886,690 | 12/1989 | Davis et al. | 428/366 |
| 4,889,731 | 12/1989 | Williams, Jr. | 426/106 |
| 5,021,515 | 6/1991 | Cockran et al. | 525/371 |
| 5,049,624 | 9/1991 | Adams et al. | 525/371 |
| 5,064,698 | 11/1991 | Courtright et al. | 426/127 X |
| 5,116,660 | 5/1992 | Komatsu et al. | 206/204 |
| 5,143,763 | 9/1992 | Yamada et al. | 206/204 |
| 5,211,875 | 5/1993 | Speer et al. | 252/188.28 |
| 5,246,753 | 9/1993 | Koyama et al. | 426/367 |
| 5,274,024 | 12/1993 | Koyama et al. | 524/440 |
| 5,350,622 | 9/1994 | Speer et al. | 726/215 |
| 5,378,428 | 1/1995 | Inoue et al. | 422/9 |

FOREIGN PATENT DOCUMENTS

| | | | |
|---|---|---|---|
| 0 454 437 | 4/1991 | European Pat. Off. . | |
| 0507207 | 10/1992 | European Pat. Off. . | |
| 0 695 628 | 9/1995 | European Pat. Off. . | |
| 4031267 | 2/1992 | Japan | 206/204 |
| 4072168 | 3/1992 | Japan | 206/204 |
| 6-227557 | 2/1993 | Japan . | |
| 4-155904 | 12/1993 | Japan . | |
| 6183465 | 7/1994 | Japan | 206/204 |
| 6-227557 | 8/1994 | Japan . | |
| 9426621 | 11/1994 | WIPO | 206/204 |

OTHER PUBLICATIONS

'The Use of Oxygen Scavengers And Active Packaging To Reduce Oxygen Within Internal Package Envrionments-';Brody,et al;Rubbright–Brody,Inc.;Sep. 1995;Final Report Mar. 1994–Sep. 1994; Title Page through 125.

JP Oxyguard R&D Toyo Seikan Kais 1–8.

*Primary Examiner*—David T. Fidei
*Attorney, Agent, or Firm*—Mark B. Quatt

[57] ABSTRACT

An oxygen scavenger film strip is included in various package configurations. The film strip is discrete and therefore can be used as a strip of any suitable length or width, to cover all or part of an oxygen-sensitive article in the package. The film strip can be used in conjunction with any suitable covering films, forming or non-forming webs, substrates, or trays; and in any suitable packaging systems such as HFFS, VFFS, VSP, modified atmosphere, thermoform/lidding, and the like. Because the film strip is made separately from the packaging films used in the particular package, the primary packaging does not have to be compromised by modifications needed to accommodate an oxygen scavenging functionality in the packaging material. The use of a discrete film strip also offers great latitude and efficiency in the dimensions of the film strip with respect to the overall package dimensions, and the placement of the film strip with respect to the packaged article.

26 Claims, 3 Drawing Sheets

SEALED ARTICLE

This application is a Continuation of application Ser. No. 08/294,669 filed Aug. 23, 1994, abandoned Jul. 9, 1996.

BACKGROUND OF THE INVENTION

It is well known that limiting the exposure of oxygen-sensitive products to oxygen maintains and enhances the quality and "shelf-life" of the product. For instance, by limiting the oxygen exposure of oxygen sensitive food products in a packaging system, the quality of the food product is maintained for a longer period of time, and food spoilage is reduced or delayed. In addition, such packaging also allows the product to be kept in inventory longer, thereby reducing costs incurred from waste and having to restock. In the food packaging industry, several means for limiting oxygen exposure have already been developed. At present, the more commonly used means include modified atmosphere packaging (MAP), and vacuum packaging using oxygen barrier film packaging. In such systems, reduced oxygen environments are employed in the packaging, and oxygen is physically prevented from entering the packaging environment. Also, packets containing oxygen scavenging agents are sometimes placed in a package for an oxygen sensitive article. Such packets are distributed by W. R. Grace and Co.—Conn. under the Ageless trademark.

Another, more recent, means for limiting oxygen exposure involves incorporating an oxygen scavenger into the packaging structure. Incorporation of a scavenger in the package can provide a uniform scavenging effect throughout the package. In addition, such incorporation can provide a means of intercepting and scavenging oxygen as it is passing through the walls of the package (herein referred to as an "active oxygen barrier"), thereby maintaining the lowest possible oxygen level throughout the package.

However, incorporating an oxygen scavenger into the packaging film itself typically requires a structural and/or compositional modification of a packaging film or laminate, in order to introduce the scavenging functionality to the film. This can in some cases compromise the film performance and properties compared with an unmodified film. It can also lead to an undesirably large inventory of different film products. In addition, the method of incorporation can limit the manufacturer's ability to tailor the nature and quantity of the scavenger to the particular film or laminate because of limitations in the method of manufacture, the degree of chemical and rheologic compatibility of the "host" film and the scavenger material during extrusion of the film, and other factors.

Thus, it is desirable to provide a discrete oxygen scavenger film strip which can be used in conjunction with a variety of packaging films and laminates, without the need to significantly modify the same films and laminates, structurally or chemically, for each desired end use.

It is particularly desirable to provide a sealed package where quantity of the active oxygen barrier is optimized based on the requirements of the particular package. That is, if a particular sealed package requires only a moderate amount of active oxygen barrier, one should be able to accommodate this without using excessive material and without undue experimentation and cost. Moreover, one should be able to accommodate a variety of different packaging requirements without maintaining a large inventory of different products.

SUMMARY OF THE INVENTION

In accordance with the present invention, a package is provided comprising: a) an oxygen-sensitive article; b) a polymeric film, the film comprising an oxygen barrier material; and c) an oxygen scavenger film strip; wherein the polymeric film encloses the article and the oxygen scavenger film strip, such that the oxygen scavenger film strip is disposed between the polymeric film and the oxygen-sensitive article.

In the preferred embodiment, the size of the oxygen scavenger film strip is based on the oxygen scavenging requirements of the package. This enables one to tailor the oxygen scavenger film strip dimensions to the particular requirements of the particular packaging application.

In addition, the present invention comprises a method for making a package which comprises: a) providing a polymeric film; b) providing an oxygen scavenger film strip; c) providing an oxygen-sensitive article; and d) enclosing the oxygen scavenger film strip and the oxygen-sensitive article in the polymeric film such that the oxygen scavenger film strip is disposed between the oxygen-sensitive article and the polymeric film.

Further features and advantages of the present invention will appear hereinafter.

BRIEF DESCRIPTION OF THE DRAWINGS

The present invention will be more readily understandable from a consideration of the following illustrative drawings, wherein.

DETAILED DESCRIPTION OF THE PREFERRED EMBODIMENTS

Figure 1:
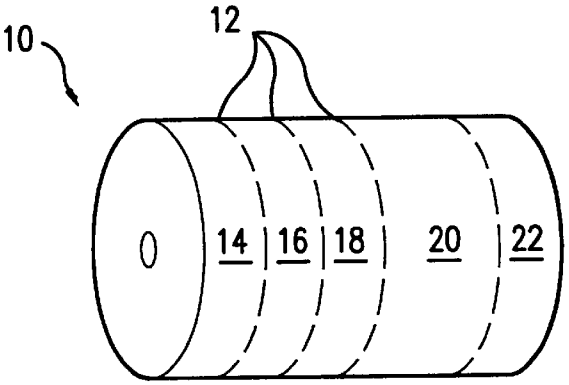
FIG. 1 is a perspective view of a roll of oxygen scavenger film for use in the present invention.
Figure 2:
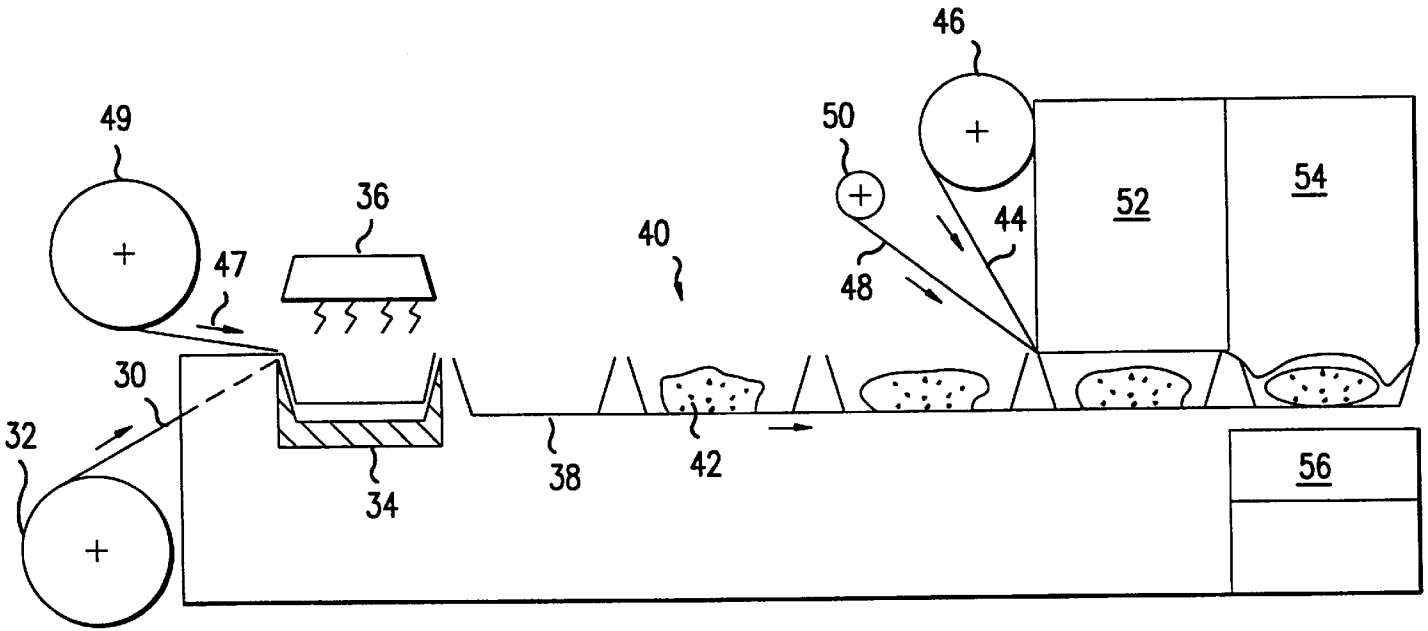
FIG. 2 is a schematic representation of a continuous process for preparing a package of the present invention.

Referring first to FIGS. 1 and 2 which show one embodiment of the present invention, FIG. 1 shows a roll 10 of appropriate oxygen scavenger film which can be slit along lines 12 into several separate component portions 14, 16, 18, 20 and 22, each of similar or different widths for use in the package of the present invention with the widths chosen based on the oxygen scavenging requirements of the particular sealed article.

The present invention may be used to form a variety of different types of packages with oxygen scavenger film strips sized to suit the desired oxygen scavenging requirements of the particular package. Examples: this invention can be used to make a rigid package with a flexible top, such as a foamed polystyrene tray with a lidstock cover. Thermoforming/dispensing equipment, such as those made or distributed by Multivac and Tiromat, can also benefit from this invention. In such equipment, a forming (thermoforming) web is formed into a cavity, an article such as a meat product is placed in the cavity, and a non-forming top web is sealed to the edge of the formed cavity to complete the package. Thermoforming can be accomplished in several ways well known in the art, including forced air, vacuum, and plug assistance. Modified atmosphere can optionally be introduced into the enclosed package before sealing, e.g. using systems such as those available from Ross Reiser. Also, vertical and horizontal form/fill/seal systems, such as those made or distributed by Ilapak, Hayssen, W. R. Grace & Co. Conn., and others can be used to package e.g. snack foods in conjunction with the present invention. Vacuum skin packaging can also be used as a system which can benefit from the invention. Any package system can be applicable where it is desired to protect the contents from the adverse effects of oxygen.

In FIG. 2, a roll stock film or laminate 30 to form the support or bottom web of a sealed package is unrolled from roll 32. The bottom web, in this case for vacuum skin packaging purposes, must be a relatively impervious sheet, for example, having a base layer of a thermoformable material such as semi-rigid polyvinyl-chloride (PVC) which is coated with saran (vinylidene chloride copolymer or PVDC) which is coated with a suitable heat sealable material such as ethylene/vinyl-acetate copolymer (EVA). Naturally, other materials may be used based on particular requirements as will be discussed hereinbelow.

As the material moves to the right, it passes over mold 34 for the tray and a heating unit 36. At this station, a thermoforming operation takes place in which the web 30 is heated by heater 36 by preferably using a heater plate in which vacuum holes are placed to draw the web 30 up against the heater plate until the web is heated to its softening and forming temperature and then release the web at which time vacuum in holes distributed across the surface of mold 34 draws the softened and formable web 30 down into the mold where it assumes the shape of the mold. After cooling and setting, the now formed cavity 38 is moved to the right to the product loading station 40 wherein desired product 42 is placed into cavity 38. The term "cavity" is used herein to mean a plastic material which has been formed into a tray, dish, or similar concave, rigid or semi-rigid structure suitable for holding an article such as a meat product. Alternative embodiments can include e.g. preformed trays such as foamed polystyrene trays, or even a simple, flat, thermoplastic substrate without any concavity. Naturally, if desired, mold 34 and heater 36 can be eliminated and a flat support web may be used rather than a formed cavity.

At loading station 40, the product 42 to be packaged is loaded into cavity 38. Naturally, if desired for efficiency, a plurality of these cavities may be formed simultaneously so that a plurality of products are also simultaneously loaded. Cavity 38 with product 42 therein is moved further to the right whereupon a covering material 44 from roll 46 is fed over cavity 38. Oxygen scavenger film strip 48 from roll 50 is fed beneath covering film 44 so that cavity 38 is at least partially covered with both the oxygen scavenger film 48 and covering film 44, with the covering film 44 being the external-most web.

Figure 3:
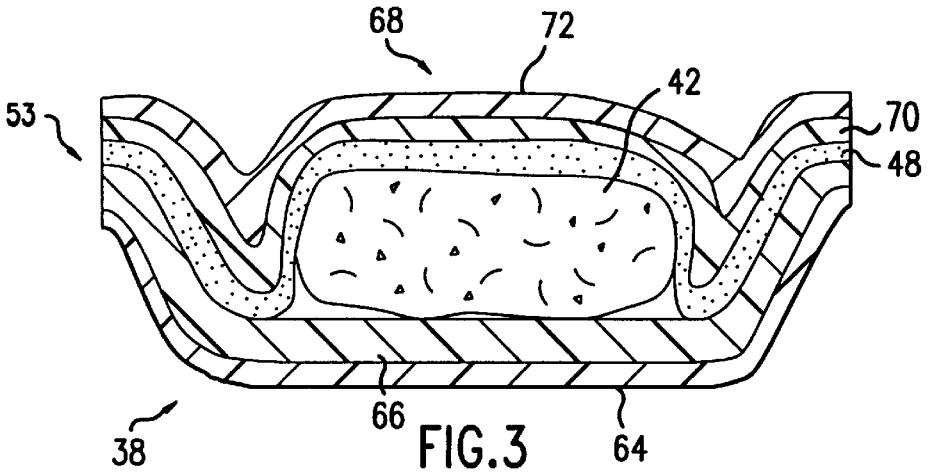
FIG. 3 is a sectional view of a completed package prepared in FIG. 2.

Covering film 44 may if desired be partly of the same material as cavity 38, although in general any suitable covering or thermoforming web may be used depending upon the particular requirements. However, the covering film should be a multi-layer film including a barrier film layer and an external packaging layer. For example, the external packaging layer may be low density polyethylene (LDPE) or ethylene/vinyl-acetate copolymer (EVA) or ethylene alpha-olefin copolymer. The barrier layer will preferably comprise either saran or ethylene/vinyl alcohol copolymer (EVOH). Alternatively, the external packaging layer may be PVC, LDPE, EVA, LLDPE (linear low density polyethylene) or VLDPE (very low or ultra low density polyethylene). Thus, in schematic fashion, the external covering includes an external plastic film layer, a barrier film layer "inside" (i.e., towards the packaged article) the external plastic film layer and an oxygen scavenger film strip 48 between the covering film 44 and the product 42. The covering material is preheated at station 52 and the assembly is moved to the next station 54, 56 where the assembly is enclosed in a vacuum chamber having upper section or covering dome 54 and lower or bottom section 56. Inside the dome, the covering material 44, 48 may be drawn against the heated interior of the dome and held there in a concave fashion while the product containing space is evacuated. When the chamber has been evacuated, the covering web 44, 48 which has been held by vacuum against the dome interior surface is released and atmospheric pressure is applied on its upper surface thus causing the pressure differential between atmospheric pressure in the evacuated chamber to force the heated film down around the product and assume the product's shape. Vacuum skin packaging (VSP) systems of this type are well known to those of skill in the packaging equipment art. As the sealable surface of the covering material comes in contact with cavity 38, it will seal and adhere thereto so that the individual package 53 has the shape as shown in the cross-sectional view of FIG. 3. Referring to FIG. 3, the product 42 is contained in cavity or tray 38 which comprises an external layer 64 of PVC and an internal barrier film layer 66 of saran. The covering 68 has an interior oxygen scavenger strip or layer 48, a central barrier layer 70 of saran and an external layer 72 of for example LDPE.

Figure 4:
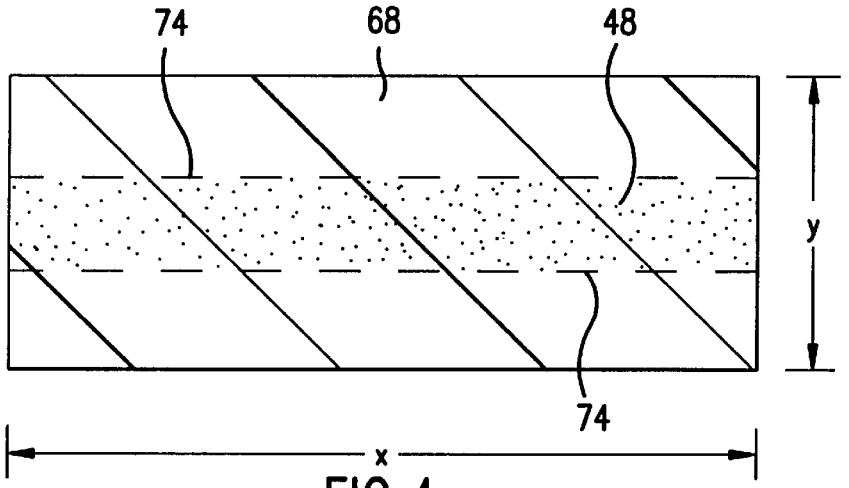
FIG. 4 is a top view of the package of FIG. 3.

Referring to FIG. 4, which represents a top view of the package of FIG. 3, it can be seen that oxygen scavenger strip or layer 48 does not necessarily cover the entire dimension of the package. Thus, the top surface has a length dimension X and a width direction Y. Oxygen scavenger layer 48 in this embodiment traverses the entire length direction X, but does not cover the entire width dimension Y. The extent of oxygen scavenger layer in the Y direction is limited by dashed lines 74. Alternatively, the oxygen scavenger strip or layer 48 may traverse the entire width dimension but not the entire length dimension.

Figure 5:
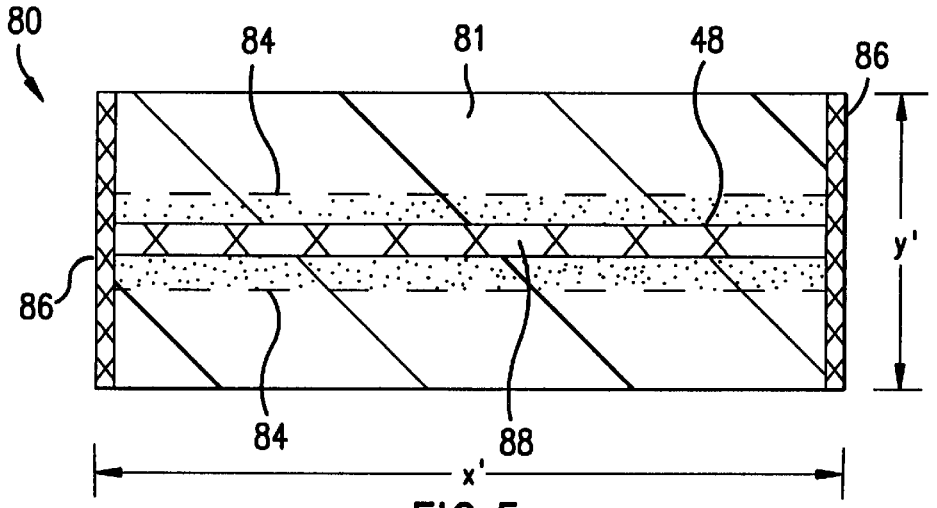
FIG. 5 is a top view of an additional embodiment of a sealed package of the present invention.
Figure 6:
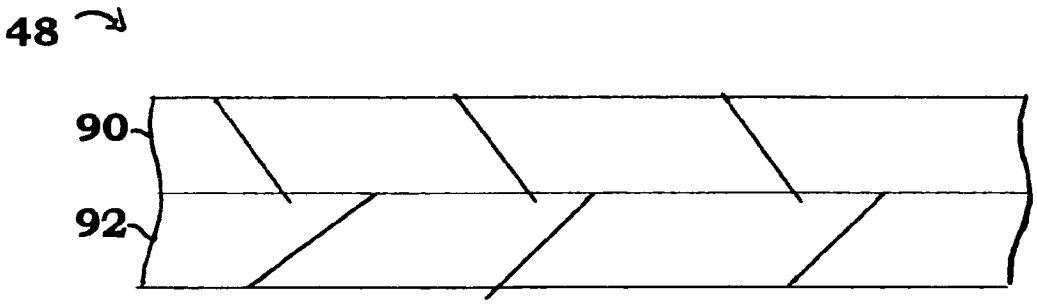
FIG. 6 is a schematic elevational section of an oxygen scavenger film strip in connection with the invention.
Figure 7:
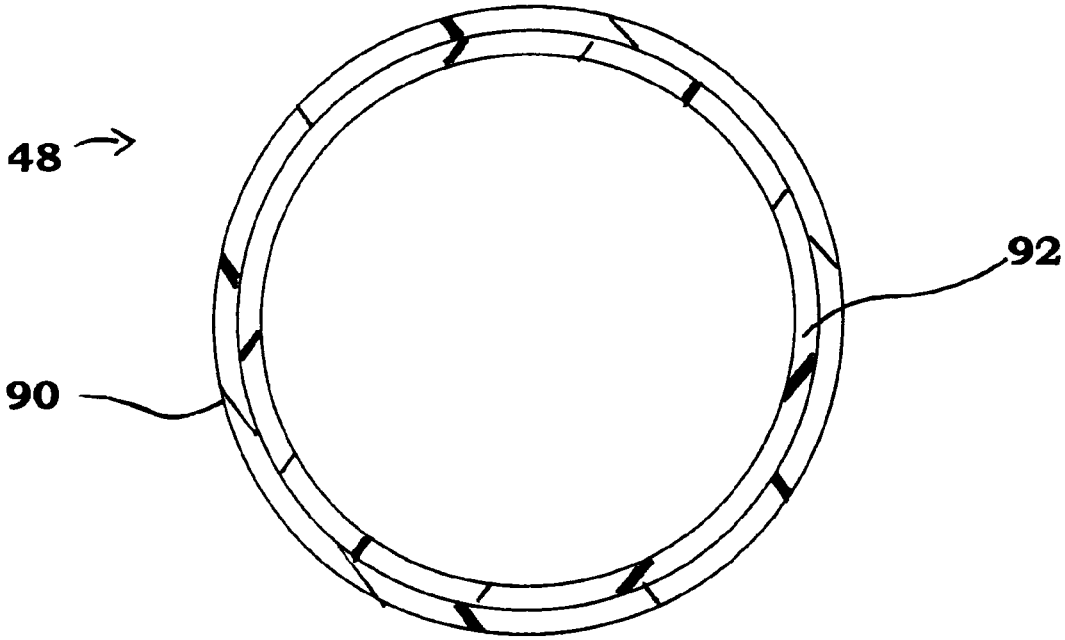
FIG. 7 is a schematic view of a tubular polymeric film in connection with the present invention.

Alternatively, one can use a vertical or horizontal form filled package 80 made from a thermoplastic film or laminate 81 as shown in FIG. 5 wherein oxygen scavenger film strip 48 covers the entire length direction X' but does not cover the entire width direction Y' with the lateral extent of the oxygen scavenger film strip 48 being indicated by dashed lines 84. Package 80 is sealed with end (transverse) seals 86 and back (longitudinal) seal 88.

The oxygen scavenger film strip is placed between the polymeric film, lid stock, etc., which has the barrier layer and the oxygen sensitive article. Therefore, oxygen which passes through the barrier layer is captured by the oxygen scavenger. The oxygen scavenger film strip should include a plastic film, a material that has an affinity for oxygen, and a catalyst such as a transition metal catalyst. The oxygen scavenger or oxidizable material may be incorporated into a relatively low cost commodity material which can be easily extruded or co-extruded. This low cost material may provide strength, low cost and easy processability desirable in a packaging product, with of course the added advantage of incorporating an oxygen scavenger. Oxygen scavengers suitable for use in films and packages of the present invention are disclosed in copending U.S. Ser. No. 052,851 filed Apr. 23, 1993, and U.S. Ser. No. 955,099 filed Oct. 1, 1992. A method of initiating oxygen scavenging generally is disclosed in U.S. Pat. No. 5,211,875. Both applications and the U.S. Patent are incorporated herein by reference in their entirety.

For example, the low cost material may be a polyolefin as linear low density polyethylene (LLDPE) or polypropylene, although others may be used such as copolymers of ethylene and propylene, and very low density polyethylene (VLDPE).

A diene monomer may be incorporated into the polyolefin to provide unsaturated groups with an affinity for oxygen and the desirable oxygen scavenging properties. Typical diene monomers include octadiene, hexadienes, 1,4-polybutadiene, non-conjugated dienes, heptadienes. The octadienes are particularly useful, as 1,6-octadienes such as 7-methyl-1,6-octadiene, 5,7-dimethyl-1,6-octadiene, etc.

Preferably, the transition metal catalyst is in the form of a salt, with the metal thereof selected from the first, second or third transition series of the Periodic Table. Suitable metals include, but are not limited to, manganese II or III, iron II or III, cobalt II or III, nickel II or III, copper I or II, rhodium II, III or IV, and ruthenium. The oxidation state of the metal when introduced is not necessarily that of the active form. The metal is preferably iron, nickel or copper, more preferably manganese and most preferably cobalt. Suitable counterions for the metal include, but are not limited to, chloride, acetate, stearate, palmitate, 2-ethylhexanoate, neodecanoate or naphthenate. Particularly, preferable salts include cobalt (II) 2-ethylhexanoate and cobalt (II) neodecanoate. The metal salt may also be an ionomer, in which case a polymeric counterion is employed. Such ionomers are well known in the art.

The function of the unsaturated end groups is to react irreversibly with oxygen during the scavenging process, while the function of the transition metal catalyst is to facilitate this process.

An outside or abuse layer may be used outside of the barrier layer, which can for example be a polyester or polyamide or polyolefin.

The total thickness of the plastic layers are preferably 0.5–2 mils with the barrier layer representing for example 5–10% of the total thickness.

The configuration of the container or package is not especially critical and will depend on the product and particular requirements. Thus, the package can simply be a heat sealed, plastic package or a formed cup-like package with a plastic overlay.

At least one of the outside or inside layers is preferably transparent so that one can view the contents of the package. However, opaque materials can also be used.

In accordance with the present invention, one permits the automatic dispensing of a generic, clear plastic film strip which incorporates an oxygen scavenging capability within the walls of the material into a package as the package is being formed. One may dispense this material into a pre-made package at the point of manufacture. The material would be sealed to the packaging material through heat or adhesive or it would become an integral part of the package if the package seals are created. The oxygen absorbing material may require a sealant layer on either side to facilitate the sealing process on thermoforming, horizontal or vertical form fill seal and modified atmosphere systems. The present invention may be utilized in virtually any system where a seal is required for final closure.

As indicated in FIG. 1, production of the material may be in mil roll form and at a gauge provided for optimum processability and scavenging rate and capacity performance, taking into account the contemplated end use, storage conditions, etc. One can select the width or length and type of oxygen scavenging material desired to achieve optimum capacity and oxygen absorbing rate for a particular package without wasting valuable material and as calculated to achieve optimum results. For example, a 4" wide package may require a 1" wide oxygen scavenger film strip. If desired, the oxygen scavenger film strip could be selected to cover the entire width and length of the package. Preferably, however, one should tailor the size of the oxygen scavenger film strip having particular width and gauge suited to the specific requirements of the application. Naturally, to enhance adhesion of the oxygen scavenger film, one can use an adhesive layer to promote bonding between the oxygen scavenger film strip and the outer material. The outer material is a film or laminate including of course the desired barrier material.

Thus, the present invention achieves significant advantages. One is able to reduce development time and cost to incorporate an oxygen scavenger system into a wide range of package types and end uses. A single oxygen scavenger material can be used for a variety of packaging requirements without having to engineer a plurality of different materials. The number of products required to be kept in inventory is reduced as well as storage and shipment of such products. Further, the present invention makes it easy to dispense and attach the desired layers and in a final consumer friendly package. The oxygen scavenger film strip can comprise a heat sealable layer, and an oxygen scavenger layer. The polymeric film can comprise a lidstock material and a thermoformed material. The thermoformed material can comprise a tray. The polymeric film can comprise a tube.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A package comprising:

a) an oxygen-sensitive article:

b) a tray onto which the oxygen sensitive article is disposed;

c) a polymeric film, the film comprising an oxygen barrier material;

and d) an oxygen scavenger film strip;

wherein the polymeric film covers the article and the oxygen scavenger film strip, such that the oxygen scavenger film strip is disposed between the polymeric film and the oxygen-sensitive article; and wherein the oxygen scavenger film strip is narrower than the package in at least one dimension.

2. The package of claim 1, wherein the oxygen scavenger film strip is attached to an interior surface of the polymeric film.

3. The package of claim 2, wherein the oxygen scavenger film strip is heat sealed to an interior surface of the polymeric film.

4. The package of claim 1, wherein the oxygen scavenger film strip comprises a heat sealable layer, and an oxygen scavenger layer.

5. The package of claim 1, wherein the oxygen scavenger film strip comprises an organic oxidizable polymer.

6. The package of claim 1, wherein the polymeric film comprises a lidstock material.

7. The package of claim 6, wherein the oxygen scavenger film strip is attached to an interior surface of the lidstock material.

8. The package of claim 7, wherein the oxygen scavenger film strip is heat sealed to an interior surface of the lidstock material.

9. The package of claim 1, wherein the oxygen scavenger film strip is attached to an interior surface of the tray.

10. The package of claim 9, wherein the oxygen scavenger film strip is heat sealed to an interior surface of the tray.

11. The package of claim 1, wherein the polymeric film comprises a tube.

12. The package of claim 11, wherein the tube has a longitudinal seal.

13. The package of claim 11, wherein the tube has at least one transverse seal.

14. The package of claim 11, wherein the oxygen scavenger film strip is attached to an interior surface of the tube.

15. The package of claim 14, wherein the oxygen scavenger film strip is heat sealed to an interior surface of the tube.

16. The package of claim 1, wherein the polymeric film comprises a vacuum skin packaging material.

17. A method of making a package comprising:

a) providing a polymeric film;

b) providing an oxygen scavenger film strip narrower than the package in at least one dimension;

c) providing an oxygen-sensitive article;

d) providing a tray;

e) disposing the oxygen-sensitive article on the tray; and f) covering the oxygen scavenger film strip and the oxygen-sensitive article with the polymeric film such that the oxygen scavenger film strip is disposed between the oxygen-sensitive article and the polymeric film.

18. The method of claim 17, further comprising the step of attaching the oxygen scavenger film strip to an interior surface of the polymeric film.

19. The method of claim 18, further comprising the step of sealing the oxygen scavenger film strip to an interior surface of the polymeric film.

20. A method of making a package comprising:

a) providing a tray;

b) placing an oxygen-sensitive article on the tray;

c) placing an oxygen scavenger film strip over the article, the oxygen scavenger film strip being narrower than the package in at least one dimension; and d) covering the oxygen scavenger film strip and the oxygen-sensitive article with a polymeric film such that the oxygen scavenger film strip is disposed between the oxygen-sensitive article and the polymeric film.

21. The method of claim 20, further comprising the step of attaching the oxygen scavenger film strip to an interior surface of the polymeric film.

22. The method of claim 21, further comprising the step of sealing the oxygen scavenger film strip to an interior surface of the polymeric film.

23. A method of making a package comprising:

a) providing a tray;

b) placing an oxygen scavenger film strip on the tray;

c) placing an oxygen-sensitive article on the tray; and d) covering the oxygen-sensitive article with a polymeric film such that the oxygen scavenger film strip is disposed between the oxygen-sensitive article and the tray.

24. The method of claim 23, further comprising the step of attaching the oxygen scavenger film strip to an interior surface of the polymeric film.

25. The method of claim 24, further comprising the step of sealing the oxygen scavenger film strip to an interior surface of the polymeric film.

26. A method of making a package comprising:

a) providing a polymeric film;

b) providing a tray;

c) forming the film into a tube;

d) placing an oxygen scavenger film strip in the tube, the oxygen scavenger film strip being narrower than the package in at least one dimension;

e) placing an oxygen-sensitive article on the tray;

f) placing the trayed oxygen-sensitive article in the tube; and g) sealing the tube such that the oxygen scavenger film strip is disposed between the oxygen-sensitive article and the polymeric film.

* * * * *